US006967904B2

(12) United States Patent
Wu et al.

(10) Patent No.: US 6,967,904 B2
(45) Date of Patent: Nov. 22, 2005

(54) ELECTRONIC WATCH FOR SPORTS APPARATUS

(76) Inventors: Peter Wu, No.1, Lane 233, Sec.2, Charng Long Rd., Taiping (TW) 411; Leao Wang, No.1, Lane 233, Sec.2, Charng Long Rd., Taiping (TW) 411

( * ) Notice: Subject to any disclaimer, the term of this patent is extended or adjusted under 35 U.S.C. 154(b) by 556 days.

(21) Appl. No.: 10/127,811

(22) Filed: Apr. 23, 2002

(65) Prior Publication Data

US 2003/0198136 A1 Oct. 23, 2003

(51) Int. Cl.[7] ..... G04B 47/00; A63B 69/00
(52) U.S. Cl. ..... 369/10; 482/9
(58) Field of Search ..... 368/10, 107, 110, 368/113; 600/300, 508, 520; 428/4, 8, 9

(56) References Cited

U.S. PATENT DOCUMENTS 4,312,358 A * 1/1982 Barney ..... 600/483
4,525,074 A * 6/1985 Murakami ..... 368/10
4,951,197 A * 8/1990 Mellinger ..... 600/300
5,301,154 A * 4/1994 Suga ..... 368/10
5,387,164 A * 2/1995 Brown, Jr. ..... 482/9
5,615,685 A * 4/1997 Suga ..... 600/300
5,853,351 A * 12/1998 Maruo et al. ..... 482/8
6,013,009 A * 1/2000 Karkanen ..... 482/9
6,095,949 A * 8/2000 Arai ..... 482/4
6,241,684 B1 * 6/2001 Amano et al. ..... 600/531
6,277,080 B1 * 8/2001 Nissila et al. ..... 600/508
6,361,502 B1 * 3/2002 Puolakanaho et al. ..... 600/508
6,450,967 B1 * 9/2002 Wu ..... 600/500
6,648,827 B2 * 11/2003 Heikkila et al. ..... 600/502

* cited by examiner

*Primary Examiner*—Vit W. Miska
(74) *Attorney, Agent, or Firm*—Kuo-Hsiung Chiu

(57) ABSTRACT

The present invention relates to an electronic watch for sports apparatus in which the international standard weight and heartbeat reference data are saved. After input of personal data of the body weight and height, the microprocessor will calculate the difference between the real body weight and the corresponding standard weight. Thereafter, the built-in program decides an optimal exercise mode in accordance with the weight difference. Then, the exerciser is activated to execute the result. In addition, the age and the sex can be given in order for the microprocessor to calculate an optimal exercise heartbeat range in taking the international standard weight and heartbeat reference data and the difference between the real body weight and the corresponding standard weight into account. Thereafter, the built-in program decides an optimal exercise mode in accordance with the optimal exercise heartbeat range. Then, the exerciser is activated to execute the result.

7 Claims, 4 Drawing Sheets

ELECTRONIC WATCH FOR SPORTS APPARATUS

BACKGROUND OF THE INVENTION

1. Fields of the Invention

The present invention relates to an electronic watch for sports apparatus, and more particularly, to an electronic watch through which an optimal exercise mode is automatically decided according to the parameter of difference between body weight and standard weight.

2. Description of the Prior Art

At present, many sports apparatuses (e.g. treadmill, etc.) utilize a smart electronic watch with built-in control program for automatically controlling the exercise modes thereof. For example, a microprocessor automatically controls the exercise time, speed, resistance or slope, etc.). It's convenient and practical.

However, the built-in control program is in form of universal control mode and not necessarily meets the needs of all users. Therefore, a few personal details of the operator, such as age, sex, etc. can be fed into the console of the conventional electric treadmill before he takes the exercise session. Even, the desired duration of the exercise session or the desired consumption of calories can also be fed in the console, and the built-in program can calculate the optimal exercise session in accordance with the fed-in data. Therefore, it's a user-oriented design.

In choosing the automatic control mode of the desired consumption of calories, the personal weight has to be given in order for the microprocessor to compute the calorie consumption value according to the exercise time and speed. However, the parameters of age, sex or calories represent great variables for different people. In brief, two persons with the same age and sex do not necessarily have the same or similar physical state. Thus, it doesn't meet the personal needs when one standard is applied to every operator.

The so-called optimal "calorie consumption value" is a reference value suggested by the physicians or fitness trainers in accordance with the personal height and weight. However, the height and especially the weight of a person are not a constant value. Unless the user always takes care of the change of his height and weight or constantly gets the new suggestion of the optimal "calorie consumption value" from the physicians or fitness trainers, the optimal "calorie consumption value" will lose its reference value.

In addition, another conventional electronic watch is provided with a heartbeat sensor. When the real heartbeat number sensed by the heartbeat sensor is greater than the preset maximal heartbeat value, a command is given to decelerate the motor to prevent from danger since the heartbeat number of the user is too high. However, the maximal heartbeat value is based on the age and the sex of a person or is a reference value suggested by physician which is variable according to the personal body type and, therefore, loses its reference value.

SUMMARY OF THE INVENTION

It is a primary object of the present invention to eliminate the above-mentioned drawbacks and to provide an electronic watch for sports apparatus through which an optimal exercise mode is automatically decided according to the parameter of difference between body weight and standard weight in taking the current height and weight into account. Accordingly, the personal need in every exercise session is completely fulfilled.

It's another object of the present invention to provide an electronic watch for sports apparatus through which the optimal exercise heartbeat range of the user is automatically decided in taking the age and the sex of the user together with the standard heartbeat list and the weight difference into account. Thereafter, an optimal exercise program runs automatically in accordance with the parameters.

DETAILED DESCRIPTION OF THE PREFERRED EMBODIMENT

Figure 1:
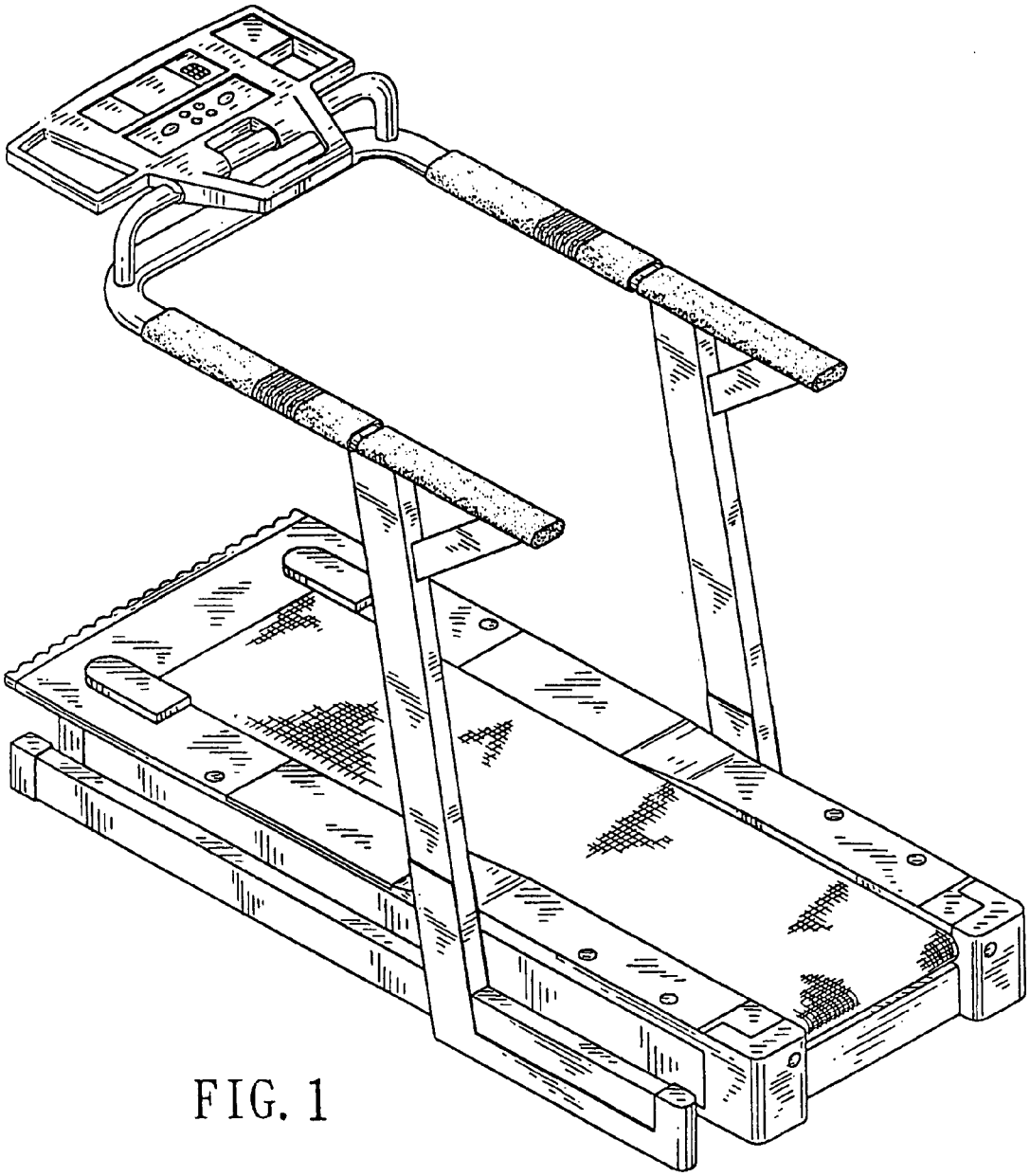
FIG. 1 is a perspective view of a treadmill controlled by the present invention.
Figure 2:
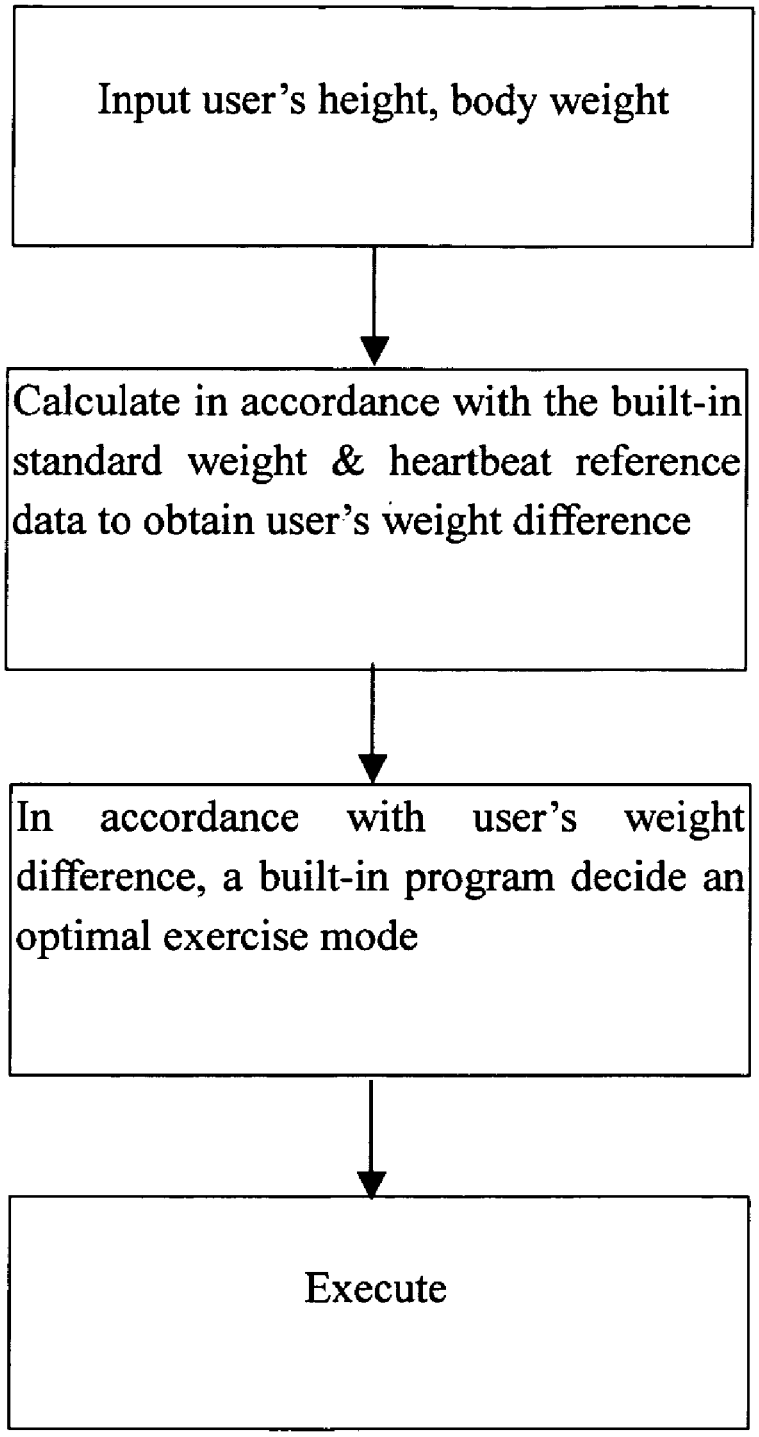
FIG. 2 is a flowchart illustrating the steps of the process of controlling the treadmill in accordance with preferred embodiment of the present invention.
Figure 3:
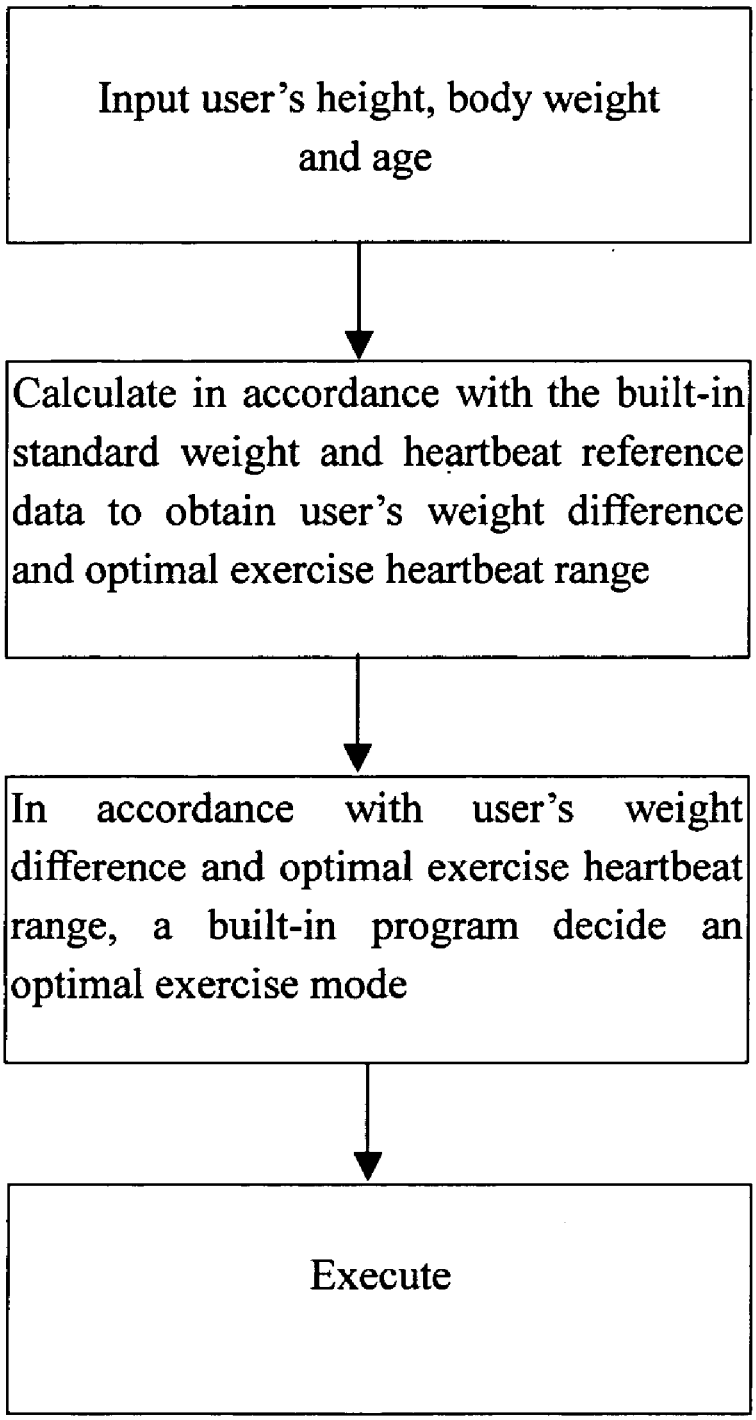
FIG. 3 is a flowchart illustrating the steps of the process of controlling the treadmill in accordance with the preferred embodiment of the present invention.
Figure 4:
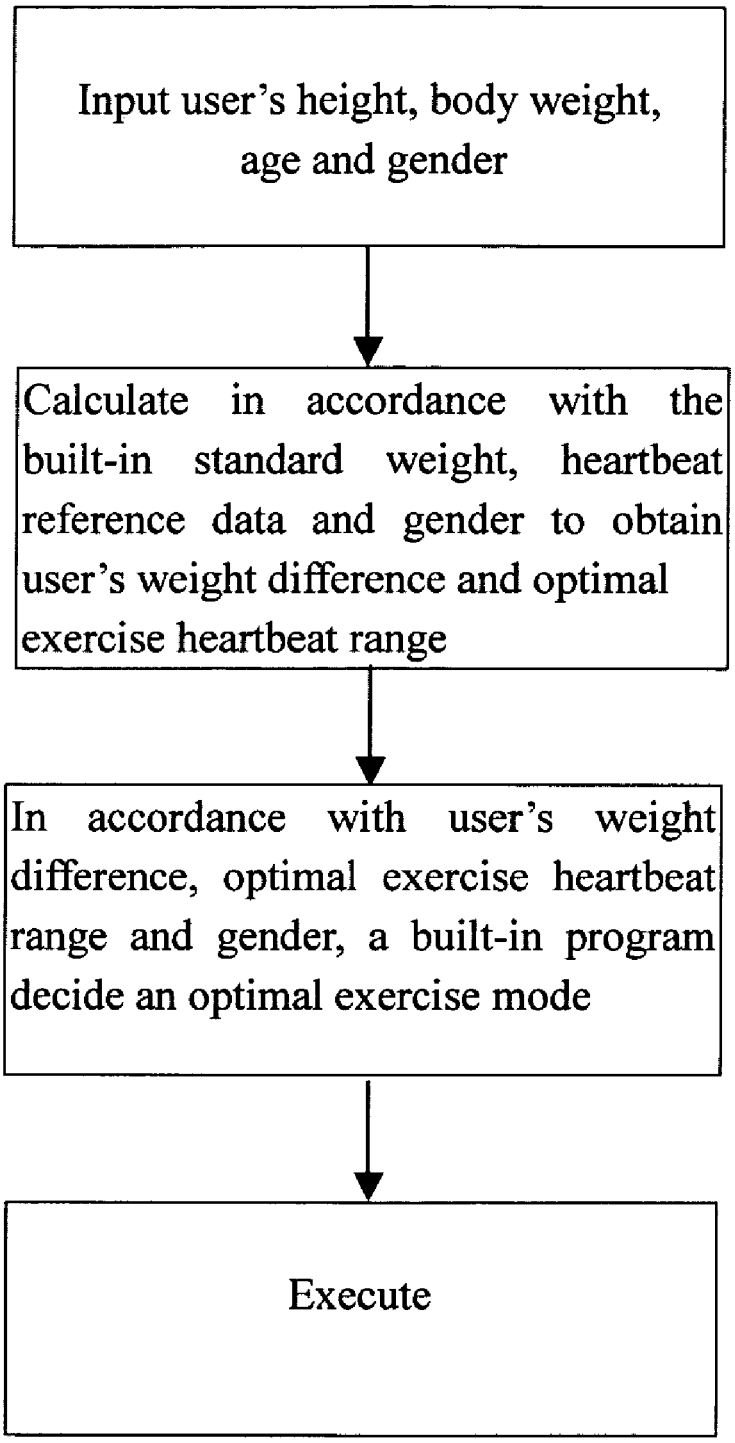
FIG. 4 is a flowchart illustrating the steps of the process of controlling the treadmill in accordance with the preferred embodiment of the present invention.

As shown in FIGS. 1–4, the present invention features:

1. The international standard weight and heartbeat reference data are built-in the microprocessor of the electronic watch. After input of personal data of the body weight and height, the microprocessor will calculate the difference between the real body weight and the corresponding standard weight. Thereafter, the built-in program decides an optimal exercise mode in accordance with the weight difference. Then, the exerciser is activated to execute the result.
2. The international standard weight and heartbeat reference data are built-in the microprocessor of the electronic watch. After input of personal data of the body weight, height and age, the microprocessor will calculate an optimal exercise heartbeat range in taking the international standard weight and heartbeat reference data and the difference between the real body weight and the corresponding standard weight into account. Thereafter, the built-in program decides an optimal exercise mode in accordance with the optimal exercise heartbeat range. Then, the exerciser is activated to execute the result.
3. The international standard weight and heartbeat reference data are built-in the microprocessor of the electronic watch. After input of personal data of the body weight, height, age and sex, the microprocessor will calculate an optimal exercise heartbeat range in taking the international standard weight and heartbeat reference data and the difference between the real body weight and the corresponding standard weight into account. Thereafter, the built-in program decides an optimal exercise mode in accordance with the optimal exercise heartbeat range. Then, the exerciser is activated to execute the result.

In brief, the electronic watch of the present invention is almost an accompanying fitness trainer giving every user to an optimal exercise suggestion and the most proper exercise session. Meanwhile, the optimal exercise heartbeat range is taken into account in order to ensure the safety of the user during the exercise session.

Since the international standard weight and heartbeat reference data are derived from the international medical reports. Thus, its reference value admits of no doubt. Therefore, no further description thereof is given hereinafter.

In all of the conventional electronic watches, they only take the body weight value into account to calculate the calorie consumption value during the exercise session. However, the present invention is based on the medical theory. The body height and weight are taken into account to learn about the body type of the user by means of the weight difference. An optimal personal exercise session is therefore decided. Accordingly, the practical value and the body building effect of the present invention can't be reached by the same type products.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electronic watch for a sports apparatus comprising:

a microprocessor selecting an operation mode and controlling an operation of the sports apparatus and having:

a) international standard weight and heartbeat reference data; and b) personal data input by a user and including user body weight and user height, wherein the microprocessor calculating a weight difference between the international standard weight and heartbeat reference data and the personal data, and selecting the operation mode and controlling the operation of the sports apparatus based upon the weight difference.

2. The electronic watch according to claim 1, wherein the personal data includes an age of the user.

3. The electronic watch according to claim 2, wherein the microprocessor calculating an optimal exercise heartbeat range using the international standard weight and heartbeat reference data and the weight difference, and selecting the operation mode and controlling the operation of the sports apparatus based upon the weight difference and the optimal exercise heartbeat range.

4. The electronic watch according to claim 1, wherein the personal data includes gender of the user.

5. The electronic watch according to claim 4, wherein the microprocessor calculating an optimal exercise heartbeat range using the international standard weight and heartbeat reference data and the weight difference, and selecting the operation mode and controlling the operation of the sports apparatus based upon the weight difference and the optimal exercise heartbeat range.

6. The electronic watch according to claim 1, wherein the personal data includes gender and age of the user.

7. The electronic watch according to claim 6, wherein the microprocessor calculating an optimal exercise heartbeat range using the international standard weight and heartbeat reference data and the weight difference, and selecting the operation mode and controlling the operation of the sports apparatus based upon the weight difference and the optimal exercise heartbeat range.

* * * * *